US011807284B2

(12) United States Patent
Katz et al.

(10) Patent No.: US 11,807,284 B2
(45) **Date of Patent: *Nov. 7, 2023**

(54) SYSTEM AND METHOD FOR DETECTION OF DEFECTS IN AN ELECTRIC CONDUCTOR SYSTEM OF A TRAIN

(71) Applicant: RAIL VISION LTD, Ra'anana (IL)

(72) Inventors: Elen Josef Katz, Haruzim (IL); Yuval Isbi, Nes Ziona (IL); Shahar Hania, Kedumim (IL); Noam Teich, Karkur (IL)

(73) Assignee: RAIL VISION LTD, Ra'anana (IL)

( * ) Notice: Subject to any disclaimer, the term of this patent is extended or adjusted under 35 U.S.C. 154(b) by 301 days.

This patent is subject to a terminal disclaimer.

(21) Appl. No.: 17/202,611

(22) Filed: Mar. 16, 2021

(65) Prior Publication Data

US 2021/0197875 A1 Jul. 1, 2021

Related U.S. Application Data

(63) Continuation of application No. 16/071,904, filed as application No. PCT/IL2017/050113 on Jan. 31, 2017, now Pat. No. 10,967,891.

(Continued)

(51) Int. Cl.

| | |
|---|---|
| ***B61L 23/04*** | (2006.01) |
| ***B61L 15/00*** | (2006.01) |
| *B61L 25/02* | (2006.01) |

(52) U.S. Cl.

CPC ..... *B61L 23/041* (2013.01); *B61L 15/0081* (2013.01); *B61L 25/023* (2013.01); *B61L 25/025* (2013.01); *B61L 2205/04* (2013.01)

(58) Field of Classification Search

CPC ..... B61L 15/0081; B61L 23/00; B61L 23/04; B61L 23/041; B61L 25/023;

(Continued)

(56) References Cited

U.S. PATENT DOCUMENTS

| | | | |
|---|---|---|---|
| 6,163,755 | A | 12/2000 | Peer et al. |
| 7,802,523 | B2 | 9/2010 | Moritzhuber et al. |

(Continued)

FOREIGN PATENT DOCUMENTS

| | | | |
|---|---|---|---|
| CN | 1214656 | | 4/1999 |
| CN | 102123899 | A | 7/2011 |

(Continued)

OTHER PUBLICATIONS

European Office Action for Application No. EP17743857.9, dated Sep. 30, 2021.

(Continued)

*Primary Examiner* — Robert J McCarry, Jr.
(74) *Attorney, Agent, or Firm* — PEARL COHEN ZEDEK LATZER BARATZ LLP

(57) ABSTRACT

A method and system for identification of obstacles near railways and for providing alarm to an operator of a train if obstacles constitute threat to the train are disclosed. The system comprise IR sensor disposed at the front of the train facing the direction of travel. The IR sensor receives images of the rails in front of the train. The system comprises pre-stored vibration profile of the train's engine that is used to eliminate influence of the engine's vibrations on the accuracy of the received images. Presence of rails in the received frames is detected based on inherent differences of temperature between the rails and the substrate in the rails' background, such as the railway sleepers and the materials underneath it. The system may detect defects in an electric conductor system of a train.

20 Claims, 12 Drawing Sheets

Related U.S. Application Data

(60) Provisional application No. 62/289,253, filed on Jan. 31, 2016.

(58) Field of Classification Search
CPC ..... B61L 25/025; B61L 2205/04; B61B 7/00; B61B 7/02; B61B 7/06; B61B 9/00
See application file for complete search history.

(56) References Cited

U.S. PATENT DOCUMENTS

| | | | | |
|---|---|---|---|---|
| 10,967,891 | B2 * | 4/2021 | Katz | B61L 15/0081 |
| 2009/0078870 | A1 | 3/2009 | Haruna | |
| 2011/0175738 | A1 | 7/2011 | Baumann et al. | |
| 2016/0152253 | A1 | 6/2016 | Katz et al. | |

FOREIGN PATENT DOCUMENTS

| | | | |
|---|---|---|---|
| DE | 198 41 246 | | 6/2000 |
| DE | 19940350 | A1 | 5/2001 |
| EP | 2551143 | | 1/2013 |
| JP | A-1998016777 | | 1/1998 |
| JP | H1016777 | | 1/1998 |
| JP | H1044997 | | 2/1998 |
| JP | 2004352108 | | 12/2004 |
| WO | WO 2005/047819 | | 5/2005 |
| WO | WO 2015015494 | | 2/2015 |

OTHER PUBLICATIONS

Office Action of Chinese Application No. 2021111094394 dated Feb. 21, 2023.

* cited by examiner

SYSTEM AND METHOD FOR DETECTION OF DEFECTS IN AN ELECTRIC CONDUCTOR SYSTEM OF A TRAIN

CROSS-REFERENCE TO RELATED APPLICATIONS

This application is a Continuation of U.S. patent application Ser. No. 16/071,904, filed on Jul. 22, 2018, published on Jan. 24, 2019 as U.S. Patent Application Publication No. 2019/0023295, which is a National Phase Application of PCT International Application No. PCT/IL2017/050113, International Filing Date Jan. 31, 2017, entitled "System and Method for Detection of Defects in an Electric Conductor System of a Train", published on Aug. 3, 2017 as International Patent Publication No. WO 2017/13206, claiming the benefit of U.S. Provisional Patent Application No. 62/289,253, filed Jan. 31, 2016, all of which are hereby incorporated by reference.

BACKGROUND OF THE INVENTION

Many train accidents worldwide occur due to the presence of obstacles on or next to the railway in a way that is invisible to the engine driver or is made visible within a distance that does not allow avoidance of hitting the obstacle. The ability to avoid an impact with such obstacle depends on a variety of factors including, for example, environment and weather dependent visibility, rail track form (curvatures, tunnels, etc.) and topography (hills and rocks that block line of sight, etc.) dependent visibility, the velocity and mass of the train (total kinetic energy) at the moment of becoming aware of the presence of the obstacle, and the size, position and color (object specific visibility) of the obstacle. Each of such factors has direct effect on the distance and time required for stopping a running train in order to avoid an obstacle accident. Some affect directly the full-stop distance and some affect the ability to notice an object and to define the object as an obstacle.

Typical decision time of the engine driver, total mass of a running train together with typical travelling speeds of trains dictate distances that exceed 1-2 kilometers for detecting an obstacle, deciding of emergency braking and braking the train, in many cases. Such distance dictates that in order to avoid an obstacle accident, the engine driver needs to be able to see an object from a two kilometers distance or similar, and be able to decide whether the observed object is indeed an obstacle that must be avoided, then be able to operate the braking means—all that before the braking distance has been exhausted. There is a need for a system and method that will assist and support the engine driver in acquiring an object along the railway, evaluating the hazard of its presence and taking an operational decision as to whether braking the train is required—all that soon enough to allow for safe braking of the train before it hits the obstacle.

SUMMARY OF THE INVENTION

A method for railway obstacle identification according to some embodiments of the present invention is disclosed, the method comprising receiving infrared (IR) images from an IR sensor installed on an engine of a train and facing the direction of travel, obtaining a vibration profile, filtering effects of vibrations from the IR images based on the vibration profile, deciding, based on pre-prepared rules and parameters, whether the IR images contain image of an obstacle and whether that obstacle forms a threat on the train's travel and providing an alarm signal if the IR images contain image of an obstacle.

According to some embodiments of the invention, the method further comprise detecting rails in the IR images based on temperature differences between the rails and their background.

According to yet further embodiments, the vibration profile is stored prior to the travel of the train.

According to yet further embodiments, the method further comprise dynamic study of the vibration profile of the train engine.

According to yet additional embodiments, the method further comprise defining a zone of interest around the detected rails and detecting objects within the zone of interest.

According to yet additional embodiments, the method comprises estimation of the direction of movement of a moving object in the received IR frames, comparing the location of the moving object in consecutive received IR images taking into account a distance that the train has passed between the acquisitions of the consecutive IR images and dividing the distance that the moving object has moved between consecutive IR images by the time period between the acquisitions of the IR images, and determining, based on the speed and direction of movement of the moving object, whether that moving object poses a risk to the train.

The method for railway obstacle identification according to some embodiments of the present invention further comprises obtaining location data from a global positioning system (GPS) unit, tracking the progress of the train based on the location data and providing information when the train approaches rail sections with limited visibility.

The method further comprises comparing pre stored images of a section of the rails in front of the train with frames obtained during the travel of the train in order to verify changes in the rails and in the rails' close vicinity and detecting obstacles based on the comparison.

In the method for railway obstacle identification according to some embodiments of the present invention, evaluating the railway conditions further comprises detecting track curvatures by observing the distance between the two tracks of the rails in obtained images of the railway.

A system for railway obstacle identification is disclosed, the system comprising an infrared (IR) sensor, installed facing the direction of travel, to acquire IR images, a processing and communication unit configured to perform the steps of the method of any preceding claim and an engine driver operation unit, configured to present the alarm signal to a user. The system further comprises, according to some embodiments of the invention, a stabilizing and aiming basis to stabilize and aim the IR sensor. The stabilizing and aiming basis may further comprise stabilization control loop based on a pre-stored vibration profile.

The system for railway obstacle identification further comprises that the IR sensor is operative in wavelength at the range of 8-12 micrometer.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
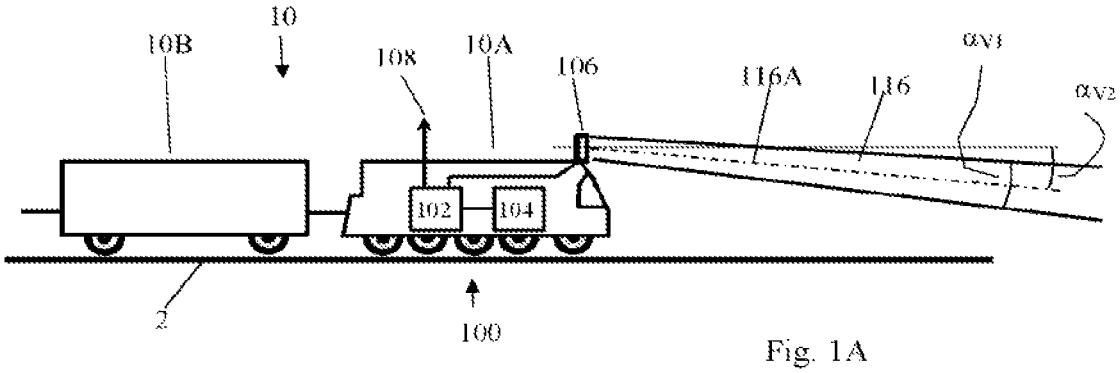
FIGS. 1A and 1B schematically depict a train equipped with a system for railway obstacle identification and avoidance, according to some embodiments of the present invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Although some embodiments of the present invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

Although some embodiments of the present invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed at the same point in time.

According to some embodiments of the present invention, a benefit is taken of the fact that railway tracks have thermal footprint that may be distinguished from its close vicinity relatively easily using thermal imaging means. The inventors of the present invention have realized the fact that train rails are made of metal and are based on railway slippers made of concrete or other materials(s) typically having low thermal conductivity. As a result, the metal rails tend to maintain relatively equal temperature along very long sections of the railway, due to high thermal conductivity of the rails, while the ground in the close vicinity of the rails maintains a vicinity temperature having lower level of homogeneity than the rails temperature homogeneity. Moreover, due to the differences in thermal conductivity and thermal specific heat between the train rails and the materials typically comprised in the ground, it is evident that the temperature division and level of the temperature along a railway is distinguished from that of the ground in its vicinity at least in both parameters.

Typical temperature differences between the rails and the ground at their background, as measured by the inventors, is 15-20 degrees, while the temperature variance of the rails along them show variance of less than 2 degrees along 1 km. This may ensure good detectability of the rails within an image frame taken by an IR sensor, and establish concrete basis for thermal imaging system and method for railway obstacle identification and avoidance. As can be seen in FIG. 5C (which is described in details herein below), for example, the difference between the objects is 20 grey levels. In typical detectors, a single gray level usually represents 50 mK degrees on 13 bit for full range. The image of FIG. 5C was taken by an 8 bit imager therefore each grey level in FIG. 5C is 2^5*50 mK=1600 mK=1.6° C. (gamma correction neglected for simplifying discussion).

Figure 1B:
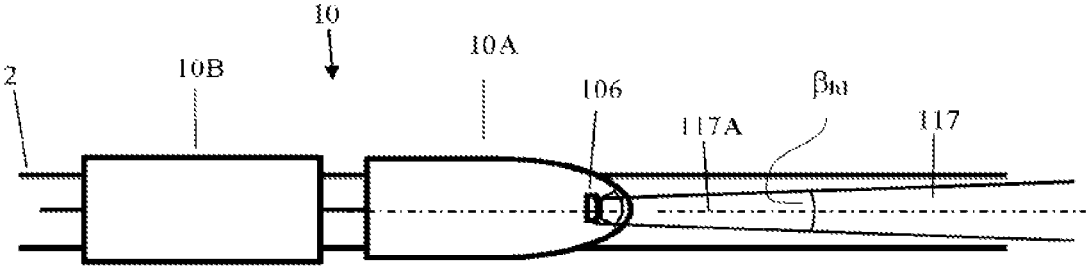

Reference is made now to FIGS. 1A and 1B, which schematically describe train 10 equipped with system 100 for railway obstacle identification and avoidance, according to some embodiments of the present invention. Train 10 may comprise one train locomotive or engine 10A at its leading end and optionally one or more railway cars 10B. System 100 may be installed on train engine 10A and may comprise processing and communication unit 102, engine driver operation unit 104, at least one infrared (IR) forward looking sensor 106 optionally located by means of camera aiming basis 106A and optionally communication antenna 108.

IR sensor 106 may be installed at the front end of engine 10A, that is at the end of the train engine that faces the direction of travel, preferably at an elevated location for better forward looking performance, as schematically depicted in the side elevation of train 10 in FIG. 1A. IR sensor 106 may have a vertical field of view 116 having an opening angle of view $\alpha_{V1}$ and its central optical axis 116A tilted in angle $\alpha_{V2}$ with respect to the horizon.

As seen in the top elevation view of train 10 in FIG. 1B, IR sensor 106 may have a horizontal field of view 117 having an opening angle of view $\beta_{h1}$, and its central axis 117A is typically directed along the longitudinal axis of engine 10A. The opening angles and the tilt down angle may be selected in conjunction with the specific target acquiring performance of IR sensor 106 so that the area of interest, which is the area the center of which is directly ahead of train engine 10A, up to about 2 km from engine 10A, and its longitudinal opening and latitudinal opening will ensure that the rails of the railway and its immediate vicinity will remain within the sight of IR sensor 106 at all expected track variations of the rails.

According to some embodiments of the present invention, IR sensor 106 may be embodied using IR imager, whether un-cooled, or cryogenically cooled, preferably in the LWIR (specifically, wavelength at the 8-12 micro-meter range) wavelength range, equipped with a lens or optical set of lenses having specific performance, as explained in details below. IR sensor 106 may be installed on a sensor stabilizing and aiming basis 106A. Stabilization and aiming may be achieved using any known means and methods. Dynamic stabilization loop may be done based on vibrations/instability measured/extracted from the taken images, or based on movement measuring sensors, such as accelerometers. IR sensor 106 may be further equipped with means 106B adapted to physically/chemically/mechanically clean the outside face of the optics of sensor 106. IR sensor 106 may be equipped with one or more of pan/tilt/zoom (PTZ) control means realized by any known means (not shown).

Figure 2A:
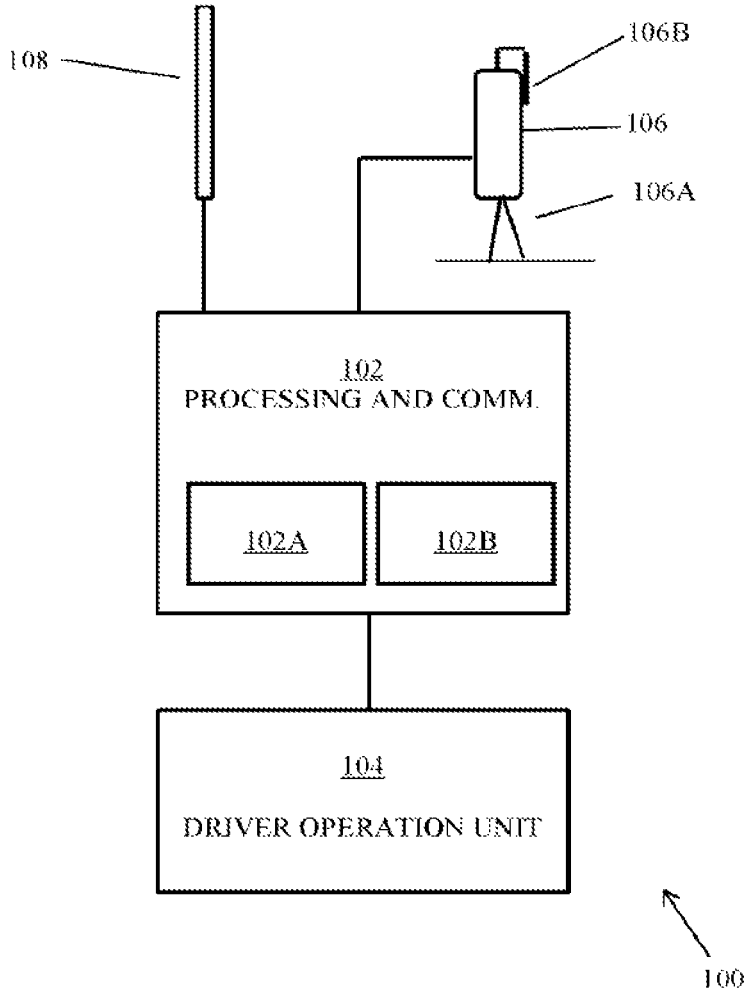
FIG. 2A is a schematic block diagram of a system for railway obstacle identification and avoidance, according to some embodiments of the present invention.

Reference is made now to FIG. 2A, which is a schematic block diagram of system 100 for railway obstacle identification and avoidance, according to some embodiments of the present invention. System 100 may comprise processing and communication unit 102, engine driver operation unit 104, at least one infrared (IR) forward looking sensor 106 and optionally communication antenna 108. Processing and communication unit may comprise processor 102A and non-transitory storage means 102B. Processor 102A may be adapted to execute programs and commands stored on storage means 102B and may further be adapted to store and read values and parameters on storage means 102B. Processor 102A may further be adapted to control driver operation unit 104, to provide data to unit 104, to activate alarm signals at, or close to and in operative communication with, unit 104 and to receive commands and data from a user of unit 104. IR sensor 106 may be in operative connection with processing and communication unit 102 to provide IR images. According to some embodiments of the present invention, system 100 may further comprise antenna 108 to enable data link with external units for exchanging data and alarms associated with the travel of train 10 with external units and systems.

According to some embodiments of the present invention, driver operation unit 104 may be adapted to enable the engine driver to receive and view dynamic stream of IR images representing the view in front of the engine, where thermally distinguished objects are presented in an emphasized manner. To select between selectable modes of operation, to activate/deactivate options, such as controlling the recording of stream of images of the view received from IR sensor 106, to acquire reference track images from remote storage devices, etc. and to receive alarm signal and/or indication when an obstacle has been detected.

The required performance of system 100 should ensure the acquiring and identification of a potential obstacle on the railway and/or in defined vicinity next to the railway well in advance, so as to enable safe braking of train 10 before it reaches the obstacle, when an accident with an obstacle has been detected. For train 10 traveling at a speed of 150 Km/h, i.e., approximately 42 m/s, the braking distance is about 1.6 Km (approx. 1 mile). Typical reaction time, which includes decision taking time and operation taking time of 10*s*, requires additional 400 m of obstacle identification distance, thus setting the detection and identification distance to 2 Km. Assuming constant deceleration of train 10, basic movement equations may be used in order to calculate the distance/time/momentary speed at any point along the slow-down track of train 10. This way, for the figures presented above, the constant deceleration a equals −1.65 m/s and the total braking time $t_B$ equals 26 s. It will be appreciated by those skilled in the art that other sets of equations may be used in order to solve the movement parameters at any point along its track, for example energy-based sets of equations, where the kinetic energy of the slowing train at any moment may be calculated as well as the maximum energy dissipation the braking wheels may provide to the rails and the ambient by way of produced heat.

Figure 2B:
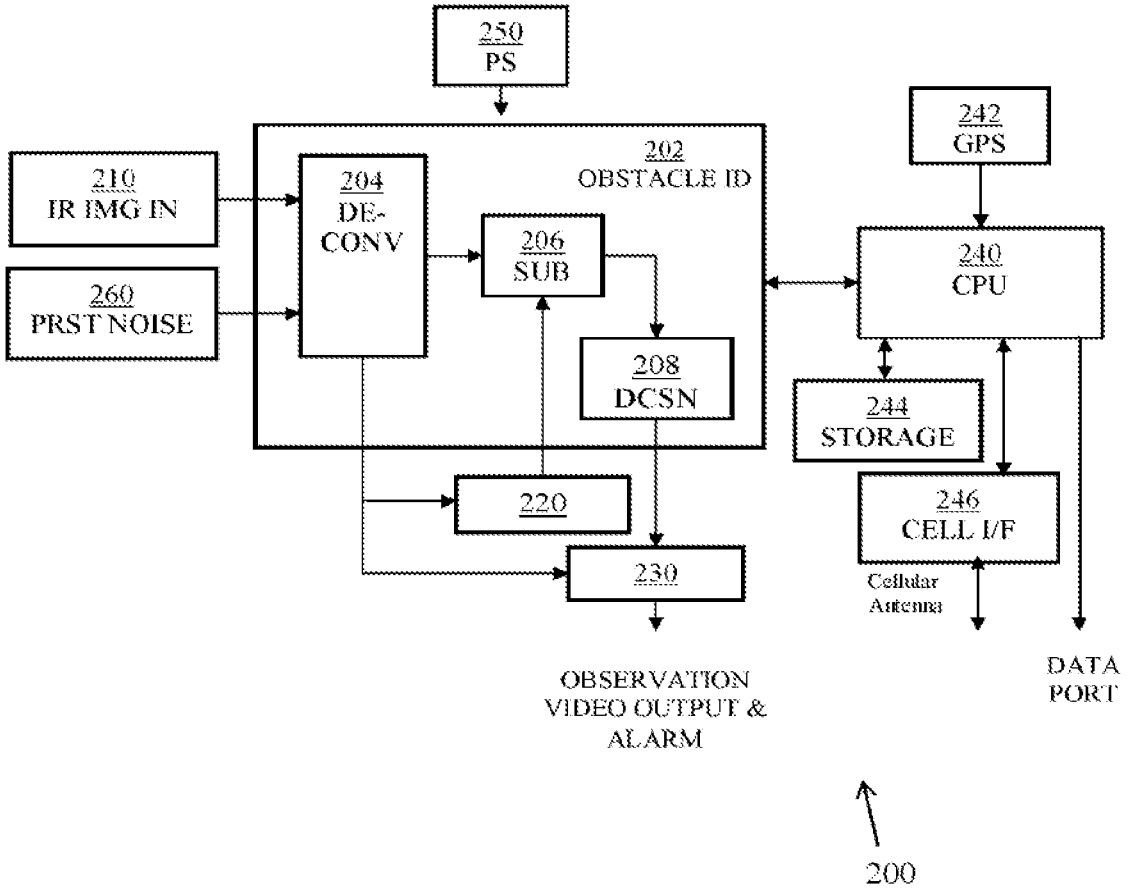
FIG. 2B is a schematic block diagram of a processing and communication unit, according to some embodiments of the present invention.

Reference is made now to FIG. 2B, which is a schematic block diagram of processing and communication unit 200, according to some embodiments of the present invention. Unit 200 corresponds to unit 102 of FIG. 2A. Processing and communication unit 200 is adapted to receive IR images 210 from an IR sensor, such as IR sensor 106 (FIG. 2A). It is assumed that at least some of the noise that appears with the image signal of IR Image 210 is repetitive and, therefore, predictable. Such noise may be recorded and saved in preset noise unit 260 or may be sampled on-line. Unit 200 may further receive past noise representation 260. IR image signal 210 and past noise signal 260 may be entered into de-convolution unit 204 to receive a de-noised image signal 204A with better signal to noise ratio. De-noised image signal 204A may be compared to previous image by way of subtraction in unit SUB 206. De-noised image signal 204A may feed de-noised images or, according to some embodiments of the invention, averaged images to be stored in unit 220 which is a non transitory fast random access memory (RAM).

The subtraction of a previous image from image 204A produces a derivative image 206A showing the changes from previous image to current image. The subtracted product 206A is fed to decision unit DSCN 208. DCSN unit 208 is adapted to analyze the subtraction product image 206A and decide, based on pre-prepared rules and parameters. Such pre-defined rules and parameters may take into considerations various arguments. For example, pre-stored images of a location that is being imaged and analyzed may enable verification of objects in the analyzed frame. In another example, effect of the actual weather, for example temperature, cloudiness, etc., at the time when analyzed images were taken may be considered to improve sensitivity and perceptivity. Relevant weather information may be extracted from the images taken by the IR sensor or be received from an external weather information source via wireless link. These rules are adapted improve the precision of temperature measurement or assessment by the IR sensor, based on the Plank's distribution. According to some embodiments these rules and parameters may be used to automatically identify, for example by decision unit DSCN 208, the point at which rails ahead of the train are curved so that their images coincide and look like a single line. At such portions of an image of the rails in order to identify whether an image that looks like a potential threat is, indeed, in a distance that poses a threat, there is a need to evaluate the distance of that object from the rails. Since at this situation lateral distance between the rails may not be extracted directly, the distance between an identified suspect object and the rails may be calculated based on the evaluation of the distance of that portion of the rails from the IR sensor and evaluation of the distance of the suspect object from the IR sensor calculated using known methods such as triangulation based on successive images of the relevant scene that were taken after intervals of time that ensure that the train has traveled long enough distance to enable calculation of the objects distance. that shall be adapted according to scene, place and weather, these rules and parameters are the possibility to measure the temperature of the object according to Plank's distribution, the expected curvature of the rails—the algorithm shall switch the detection algorithm from frontal view to side view above the rails, whether the analyzed image, or succession of images, contain image of an obstacle and whether that obstacle forms a threat on the train's travel. In case a threatening obstacle has been detected, a combined signal 230A may be produced and provided to driver operation unit, such as unit 104 (FIG. 2A). Combined signal 230A may comprise alarm signal and obstacle indication overlay video to indicate identified obstacle on the video frame received from de-convolution unit 204.

Cellular interface unit 246 is adapted to manage cellular communication of unit 200, and it may be controlled, may receive and may provide signals, commands and/or data from CPU unit 240.

Global positioning system (GPS) unit 242 may manage location data as extracted from signals received from GPS satellites. Location data 242A may be utilized for tracking the progress of the train by a train management system (not shown), for train-to-train relative location data by receiving indications of the location of other train in the relevant vicinity and for advance informing of the engine driver when the train approaches rail sections with limited visibility due to, for example, a curvature over a hill. Location data may also be used for synchronizing frames of past travels on the current rails that may be received over the wireless communication channel (such as cellular channel) with frames of current travel in order to verify changes in the rails and their close vicinity.

CPU unit 240 is adapted to control the operation of at least some of the other units of unit 200 by providing required data and/or control commands, and by synchronizing the operation of the other units. Software programs, data and parameters required for the operation of unit 200 may be stored in non-transitory storage unit 244, which may be any known read/write storage means. Programs stored in storage 244, when executed, may cause unit 200 to perform the operations and activities described in this description.

Unit 200 is an example for embodiment of unit 102 of FIG. 2A. However, unit 102 may be embodied in other ways. Unit 200 may be embodied, as a whole or parts of it, on a separate unit, or as part of a system or of a user-specific chip, or as software only performed on an existing platform and controlling existing unit/s. All power consumers of unit 200 may be powered by power supply unit 250.

According to some embodiments of the present invention, the required effective field of view, denoted EF, is required to cover the rails and external margins of the rails. Considering distance of 1.5 m between the rails the opening angle of view for 1.5 m in 2 Km distance equals about 1 mRad. IR imagers may be found ready in the market with resolution in the range of 256×256 to 1000×1000 pixels, and higher. Assuming a latitudinal dimension of 0.5 m for an obstacle of interest, in a 2 Km distance, such obstacle occupies about 0.25 mRad, which dictates 2 cycles/mRad sampling. Compliance with the requirements of Nyqvist sampling frequency dictates sampling frequency $f_N$=4 cycles/mRad. According to the Johnson's criteria for recognition of an object acquired by an imager, the sampling frequency for ensuring recognition $f_{REC}$ equals:

$$f_{REC}=f_N*6=4*6=24\text{cycles/mRad}$$

Accordingly, the field of view (FOV) of each latitudinal pixel FOVpa equals:

$$\text{FOV}_{PIX}=1/f_{REC}=1/(24*10^{-3})\approx 40\ \mu\text{Rad}$$

For a typical pixel having latitudinal dimension of 20 μm in a commercially available IR sensor, the focus length f will be:

$$20*10^{-6}=f*40*10^{-6}$$

$$f=0.5\text{ m}$$

Focus length f of 0.5 m is required for ensuring recognition of an obstacle of 0.5 m latitudinal size from a distance of 2 Km. Naturally ensuring recognition at shorter distances will impose weaker constrains. For example, an obstacle at a distance of 500 m will occupy 4 times the number of pixels, which means that 48 pixels/target suffice the Johnson's criteria, which in turn allow use of an IR imager of 256*256 pixels (256×256 may be suitable for distance longer than 500 m). As long as imaging errors, such as errors stemming from inaccurate installation or dynamics of the line of sight of the sensor, does not exceed $$e_{loc/vib}=\pm 40\ \mu\text{Rad}*(256-48)/2=104*40\ \mu\text{Rad}=4.16\text{mRad},$$

it will be considered negligible; however, larger errors will require higher resolution of the IR imager which will increase system's costs. For detection purposes only the focus length may be $$0.5\text{m}/6=0.0833\text{m}$$

In cases where relatively short focus lengths are required, the sensitivity may be improved by decreasing the F #.

The focal length can be decreased to about 150 mm or so in order to ease production and decrease dimension when the main goal of the system is obstacle detection.

Thermal systems used for object detection typically have F/2 figure which supports Noise-Equivalent temperature difference (NETD) distinction of ~100 mKelvin per pixel, which supports detection of an obstacle from distances longer than 2 Km. In cases when the obstacle of interest is a living body of, for example, human, the temperature difference between that of the human body and that of the ground around his image may vary between 5° K and 25° K. As a result, the signal-to-noise (SNR) ratio may be 50 or higher.

According to some embodiments of the present invention, certain ranges of probability of detection (POD) of an obstacle of interest and certain ranges of false alarm ratio (FAR) are required.

Figure 3:
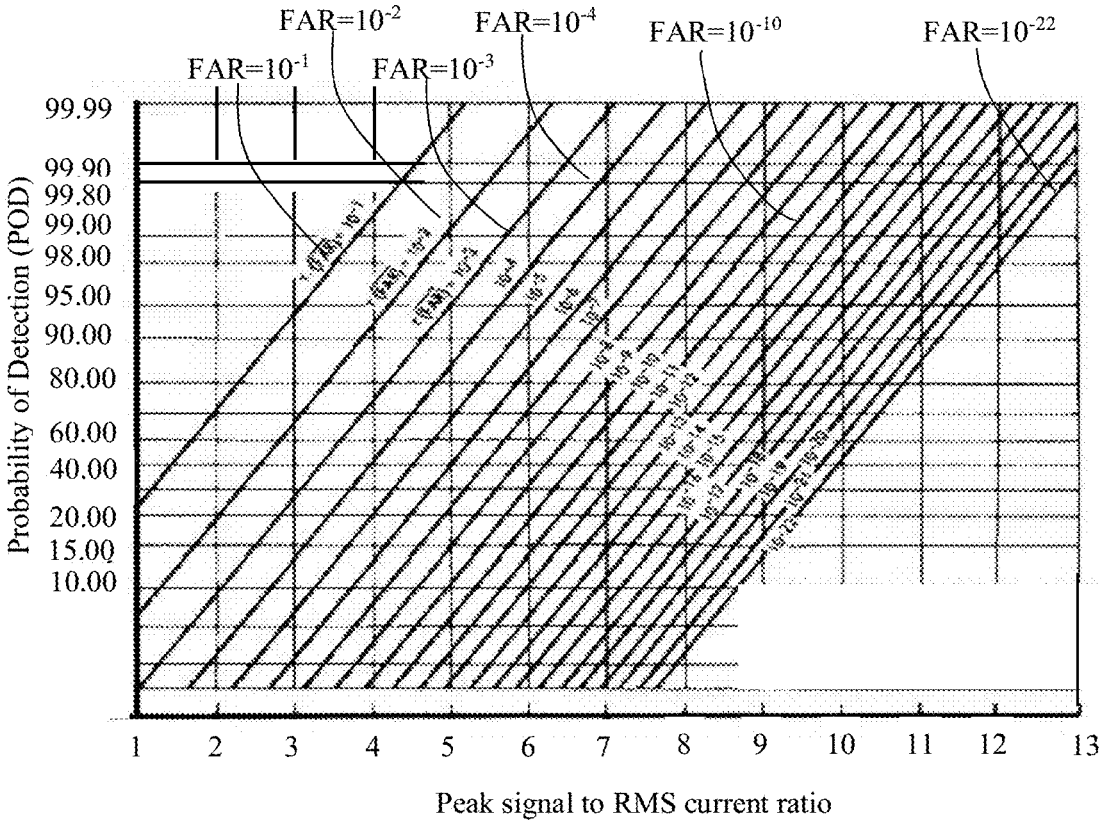
FIG. 3 is an exemplary graph depicting the relations between the magnitude of SNR, POD and FAR according to some embodiments of the present invention.

Reference is made now to FIG. 3, which is an exemplary graph depicting the relations between the magnitude of SNR, POD and FAR according to some embodiments of the present invention. SNR is expressed in dimensionless figures and is presented on the horizontal axis and the POD is expressed in percentage and is presented along the vertical axis, for given FAR, expressed in dimensionless figures. As may be seen in the graph of FIG. 3, for a given FAR value, the POD value is directly proportional to the SNR value, and for high enough values of SNR, e.g., higher than 12.5, the value of POD is above 99, even with FAR equals to $10^{-22}$, that is—with high enough SNR, the value of FAR may be neglected. Yet even with FAR values higher than those specified above, system 100 may still be of assistance to the engine's driver, as it will draw his attention to the alarm, when unit 200 has been tuned to provide alarm signal in this range. With SNR equals to 10, the values of FAR are very low, and with SNR higher than 10, it is evident that the values of FAR are practically zero. The values of POD for SNR equals to 10 is close to 99.99% for a single frame acquired by sensor 106 and of course the value of POD goes much closer to 100% if two or more frames are acquired.

A system for railway obstacle identification and avoidance according to some embodiments of the present invention, such as system 100, may operate in at least two different ranges of wavelength. First wavelength range, also known as mid-wavelength infrared (MWIR), is 3-8 μm and the second range, also known as long wavelength infrared (LWIR), is 8-15 μm. Operation of the system in each of these ranges involves its own advantages and drawbacks. Operating in the MWIR range has advantages when there is a need to detect an Infrared (IR) missile plume. As used herein, an IR missile plume may refer to the IR radiation emission from the exhaust of the missile. Additionally, MWIR range has better transferability in good atmosphere conditions, e.g., in an environment having low level of air turbulences. Operating in the LWIR range has a substantive advantage when operating in environment having high level of air turbulences. The transferability of waves in the IR range is much higher when the wavelength of the IR energy is in the LWIR range. The effect of turbulences on the performance of an imager may be evaluated using the parameter Cn2 which indicates the level of variance of the refraction factor of the media between the object of interest and the imager. This unit has a physical dimension $[m^{-2/3}]$ and the higher the number is the higher is the variance in refraction number and as a result—the lower is the performance of the imager.

Figure 4:
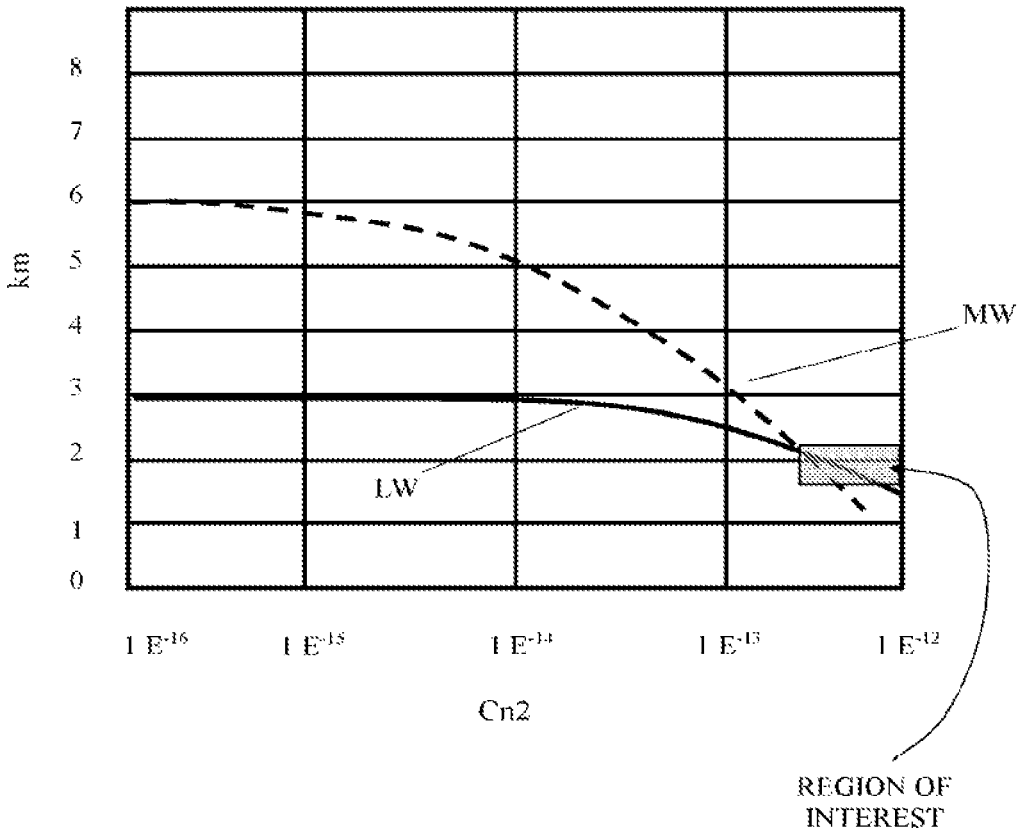
FIG. 4 schematically presents the transferability of IR wavelength in the MW and the LW wavelength ranges as a function of turbulences, according to some embodiments of the present invention.

Reference is made now to FIG. 4, which schematically presents the transferability of IR wavelength in the MW and the LW wavelength ranges as a function of turbulences, according to some embodiments of the present invention. The transferability of IR wavelength in the MW and the LW wavelength ranges as a function of turbulences Cn2, presented along the horizontal axis, in the medium between the observed object and the object and the imager, presented along the vertical axis. As seen in FIG. 4, the transferability of MWIR at low levels of turbulences Cn2 is higher than that of LWIR. However, the effect of turbulences on MWIR is much higher than that on LWIR, and in the region of interest, range of 2 km and high level of turbulences, the transferability of LWIR is better.

The advantage of operating a system according to some embodiments of the present invention, such as system 100, in the LW range of the IR spectrum applies also when operating in low visibility conditions. The transferability of an imaging system may be evaluated by the Rayleigh equation of diffraction $$I = I_0 \frac{1+\cos^2\theta}{2R^2}\left(\frac{2\pi}{\lambda}\right)^4\left(\frac{n^2-1}{n^2+2}\right)^2\left(\frac{d}{2}\right)^6,$$

in which the element $(1/\lambda)^4$ is of most importance for transferability in bad weather conditions, where use of long wavelengths proves high transferability.

According to some embodiments of the present invention, a system for railway obstacle identification and avoidance, such as system 100, may automatically focus on the image of the rails of the railway in the image frame. The image of the rails is expected to have high level of distinction in the frame, mainly due to the difference between its temperature and the temperature of its background in the image frame. Railway rails are made of metal, typically of steel, which has heat transmission coefficient that is different from that of the ground on which the rails are placed. The heat transmission coefficient of iron is 50 $W/m^2 \cdot k$ (watt per square meter Kelvin) while the equivalent heat transmission of ground, comprising rocks, soil and air pockets, is lower than 1 $W/m^2 \cdot k$. This difference ensures noticeable difference in the temperature of the surface of the rails, compared with its background's temperature during all hours of the day and through all ranges of weather changes.

A system according to some embodiments of the present invention needs to be able to identify an obstacle of about 0.5 m width from a distance of 2 km or more, through medium which may be contaminated or have low visibility, with refraction variances, etc. Additionally, the IR sensor is subject to complex set of vibrations due to its installation on the train engine, which travels in high speeds. Such complex set of vibration includes specific vibrations of a specific engine, vibrations stemming from the travel on the rails, etc. Vibrations induced from the train engine to the IR sensor may incur two different types of negative effects to the acquired image. The first negative effect is the vibration of the acquired image, and the second negative effect is the smearing of the image.

The result of the first negative effect is an image in which each object appears several times in the frame, in several different locations, shifted with respect to one another in the longitudinal and/or the latitudinal directions, by an unknown amount. The result of the second negative effect is smearing of the object in the frame which diminishes the sharpness of the image. Handling of the first negative effect is harder, as it is hard to automatically determine which pixels represent the object, thus eliminate the possibility to register the exact location of the pictured object in the frame and following that to clean the negative effect by subtraction. The second negative effect is easier to handle, as the object may be extracted by averaging the smeared object in time to receive the true object.

According to some embodiments of the present invention, the specific nature of vibrations of a specific train engine may be recorded, analyzed and studied, for example by storing vibration profiles for specific engines, and/or for an engine in various specific travelling profiles and/or for an engine travelling along specific sections of the railways. Such vibrations data may be stored and may be made ready for use by a system, such as system 100. According to alternative or additional embodiments of the present invention, the specific nature of vibrations of a specific engine may be dynamically studied and analyzed in order to be used for sharpening the obstacle IR image.

According to yet additional embodiments of the present invention, the acquired IR image may further be improved to overcome the negative effect of vibrations, by relying on the assumption that as long as at least one of the railway rails is in the imager's line of sight (LOS), the extraction of the effect of vibrations may be easier, relying on the easiness to locate a rail in the image frame due to its distinguished thermal features, as discussed above. In order to improve the taken IR image a Weiner Filter may be used. The frequency response of a Weiner Filter may be expressed by: where:

$$G(w_1, w_2) = \frac{H^*(w_1, w_2)S_{uu}(w_1, w_2)}{|H(w_1, w_2)|^2 S_{uu}(w_1, w_2) + S_{\eta\eta}(w_1, w_2)},$$

$S_{\eta\eta}(w_1,w_2)$ is the noise spectrum as taken from a location in the frame having a uniform dispersion, and $S_{uu}(w_1,w_2)$ is the spectrum of the image of the original object.

According to some embodiments of the present invention, images taken along a railway track may be stored for a later use. One such use may be for serving as reference images. System 100 may fetch pre stored images that correspond to the section of the railway currently viewed by IR sensor, such as sensor 106, as described, for example, with respect to FIG. 2B. The pre stored images may be fetched based on continuous location info received, for example, from GPS input unit 242. The pre stored images, assuming that they are of higher quality, may be used for comparison, e.g., by subtraction. Additionally or alternatively, pre stored references track images may be received from a remote storage means fetched over a communication link, such a cellular network.

The inventors of the invention, some embodiments of which are the subject of the current application, have performed experiments to compare detection of rails of a railway and of objects placed next to the rails, from images taken in during day light hours and in the dark hours by an IR sensor versus images of the same rails and objects taken by a regular camera during the same times. The rails were totally invisible in the images taken by the regular camera during dark hours, but were clearly visible in the images taken by the IR camera at the same time. Additionally, the experiment discovered that even during the light hours, rails photographed by a regular camera were completely invisible when crossed a shaded area but were sufficiently visible when viewed by an IR sensor. It was realized that, even though the temperature of the rail passing in a shaded area was lower than the temperature of the rail exposed to the sun light, due to the high heat transmission figure of the rail, some heat was transferred from the portions exposed to the sun light and as a result its temperature in the shaded area dropped less than that of the ground around it, and as a result it remained distinguished in the IR frame.

Reference is made now to FIGS. 5A-5E, which are images of the scene ahead of a train engine, taken and processed according to some embodiments of the present invention.

Figure 5A:
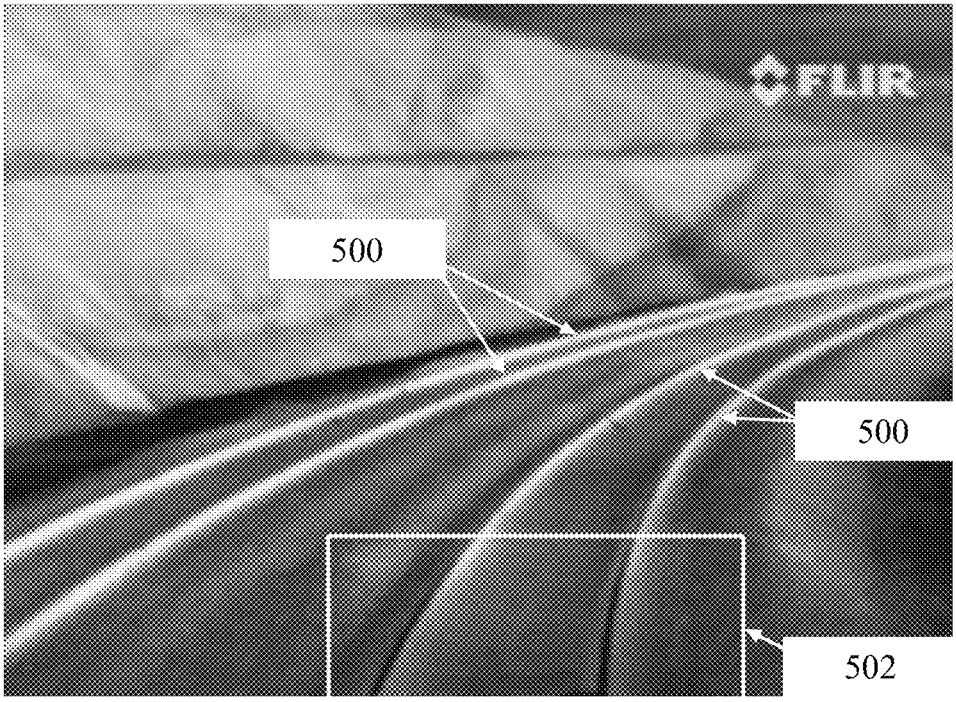
FIG. 5A is an image taken by IR imager which presents the visibility of portion of rails in a shaded area, according to some embodiments of the present invention.

FIG. 5A is an image taken by IR imager located in front of a train engine presenting the visibility of portion of the rails 500 in a shaded area as seen inside white frame 502, according to some embodiments of the present invention. It can be seen that the part of railway 500 that is located inside frame 502 (shaded area) is distinguishable in the IR image even when they are not distinguishable to human eye.

Figure 5B:
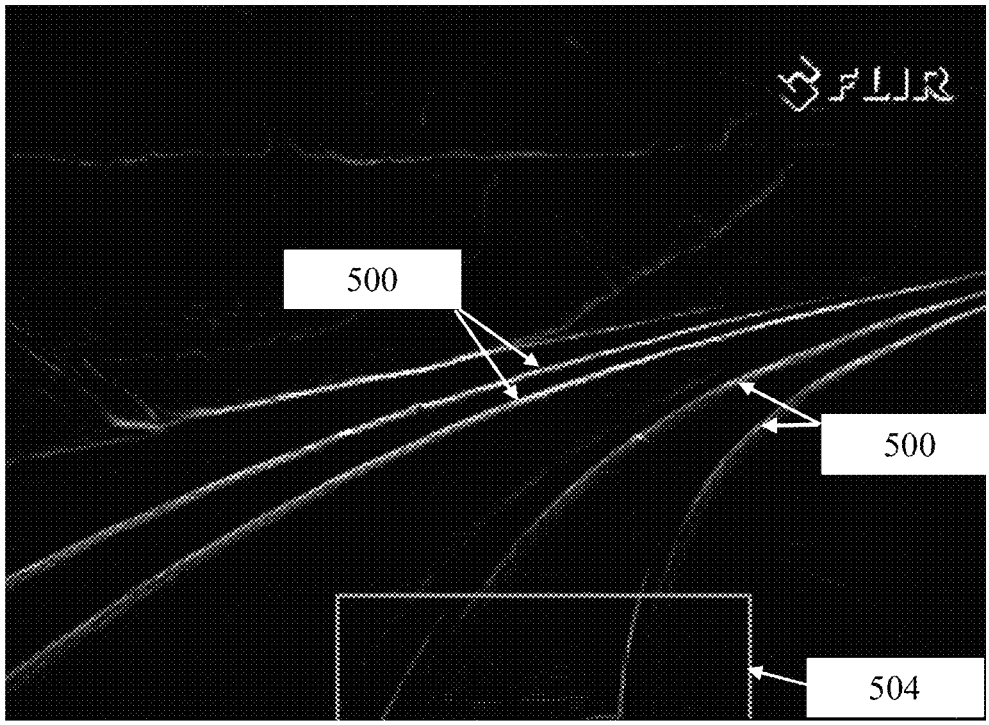
FIG. 5B is an image of the same scene shown in FIG. 5A of the rails after being subject to a filter, according to some embodiments of the present invention.
Figure 5C:
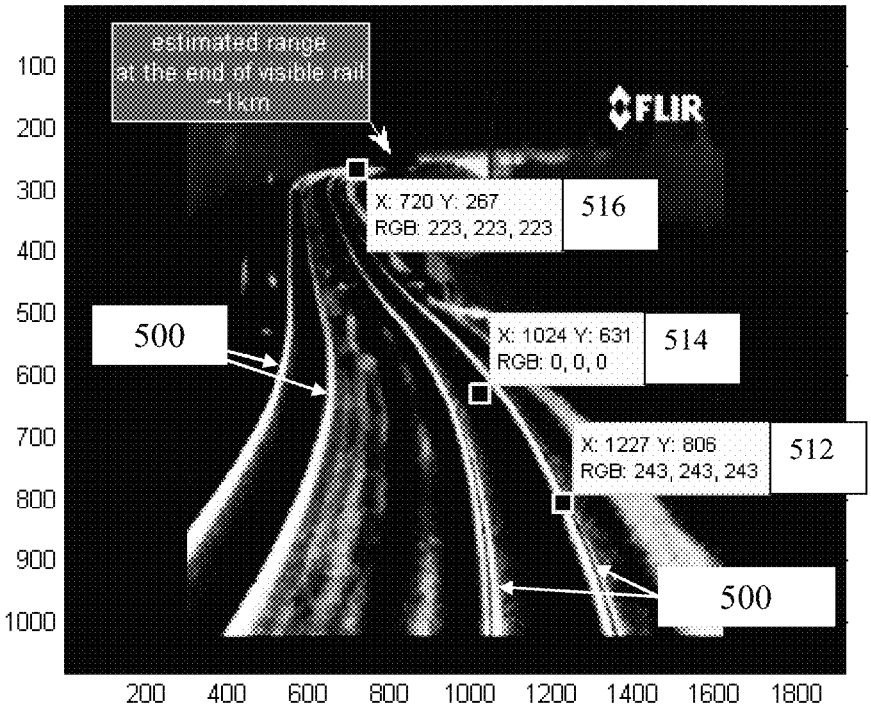
FIG. 5C is an image showing the temperature variance of rails at two different points along the rails and the difference of temperatures between the rails and their background, according to some embodiments of the present invention.

FIG. 5B is an image of the same scene shown in FIG. 5A of rails 500 after being subject to a filter, according to some embodiments of the present invention. In the example of FIG. 5B, a first order derivative filter, also referred to as a first order differential filter is applied for edge detection. Here also rails 500 in the shaded area of the image, within white frame 504, are well distinguishable in pattern of the shaded area.

FIG. 5C is an image showing the temperature variance of rails 500 at two different points along the rails and the difference of temperatures between the rails and their background, according to some embodiments of the present invention. Locations 512 and 516 are points on rails 500 distanced from each other about 1 km. Extracting the difference in temperature between points 512 an 516 by the difference in grey level (which is 20 levels), the calculated difference is about 1.6° C. over 1 km. The grey level measured at point 514 is 0, which is distinguished from the representation of the rails by about 230 levels—which is a huge difference. Thus, it is evident that then variance of temperature along the rails is negligible compared to the difference in temperatures between the rails and their background.

Figure 5D:
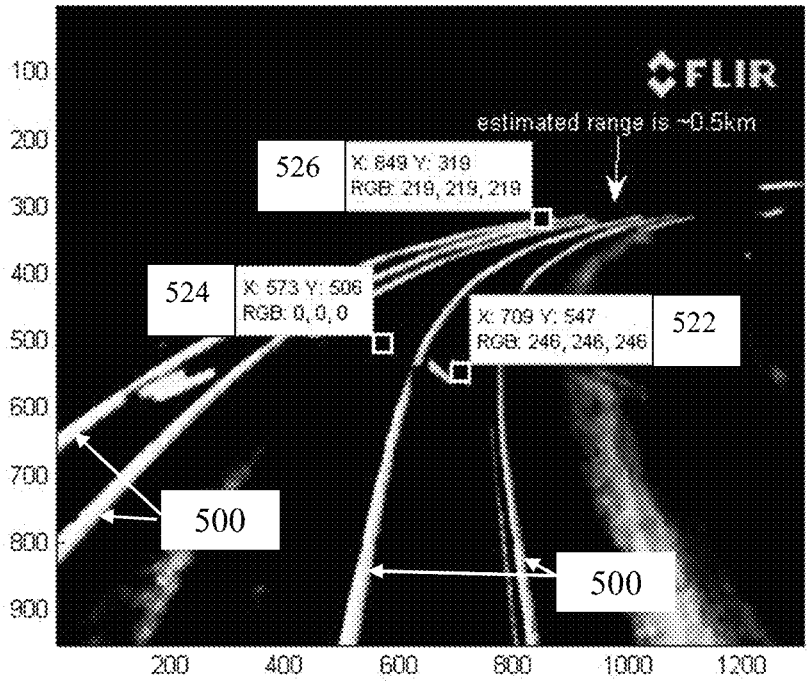
FIG. 5D is an image presenting the difference in temperatures between an obstacle located between the rails, the background between the rails and the rails at a distance of about 0.5 km from the imager, according to some embodiments of the present invention.

FIG. 5D is an image taken by IR imager located in front of a train engine presenting the difference in temperatures between an obstacle 522 located between the rails 500, the background 524 between the rails 500 and the rails 526 at a distance of about 0.5 km from the imager, according to some embodiments of the present invention. Similarly to the analysis of the temperatures in FIG. 5C, here also the temperature of the background 524 differs by about 246 grey levels (which is approximately 80 mK*246~20° C.) from the temperature of obstacle 522 and by about 220 grey levels (which is approximately 17.5° C. degrees) from the temperature of the rails 526 at a distance of approximately 0.5 km. This again exemplifies the visibility by the IR imager of the rails 500 and an obstacle 522.

Figure 5E:
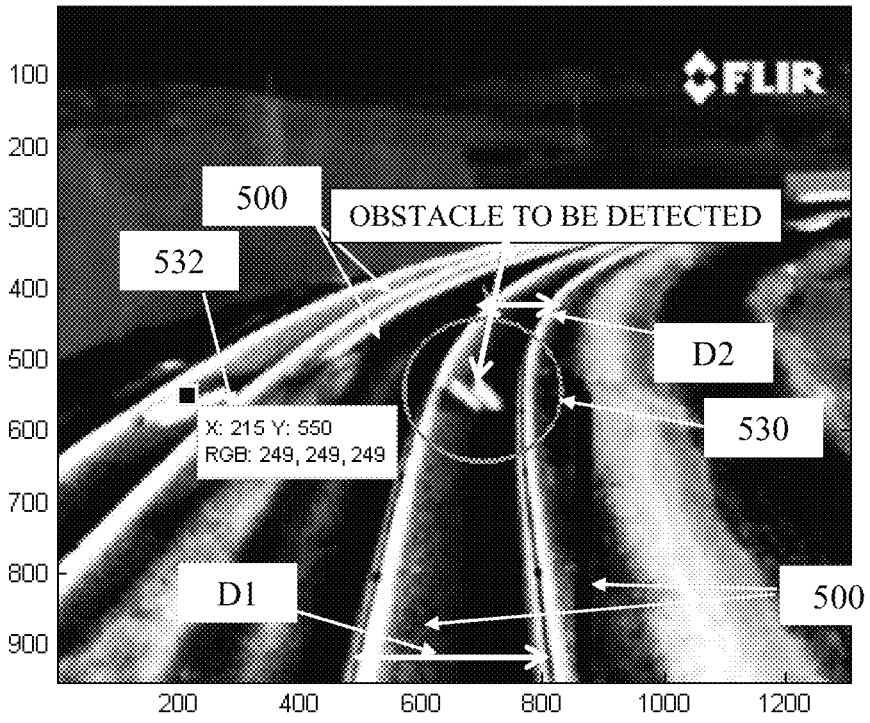
FIG. 5E is an image presenting the high visibility of two different obstacles and of the rails versus the background, according to some embodiments of the present invention.

FIG. 5E is an image taken by IR imager located in front of a train engine presenting the high visibility of obstacles 530 and 532 and of rails 500 versus the background, according to some embodiments of the present invention.

Figure 6:
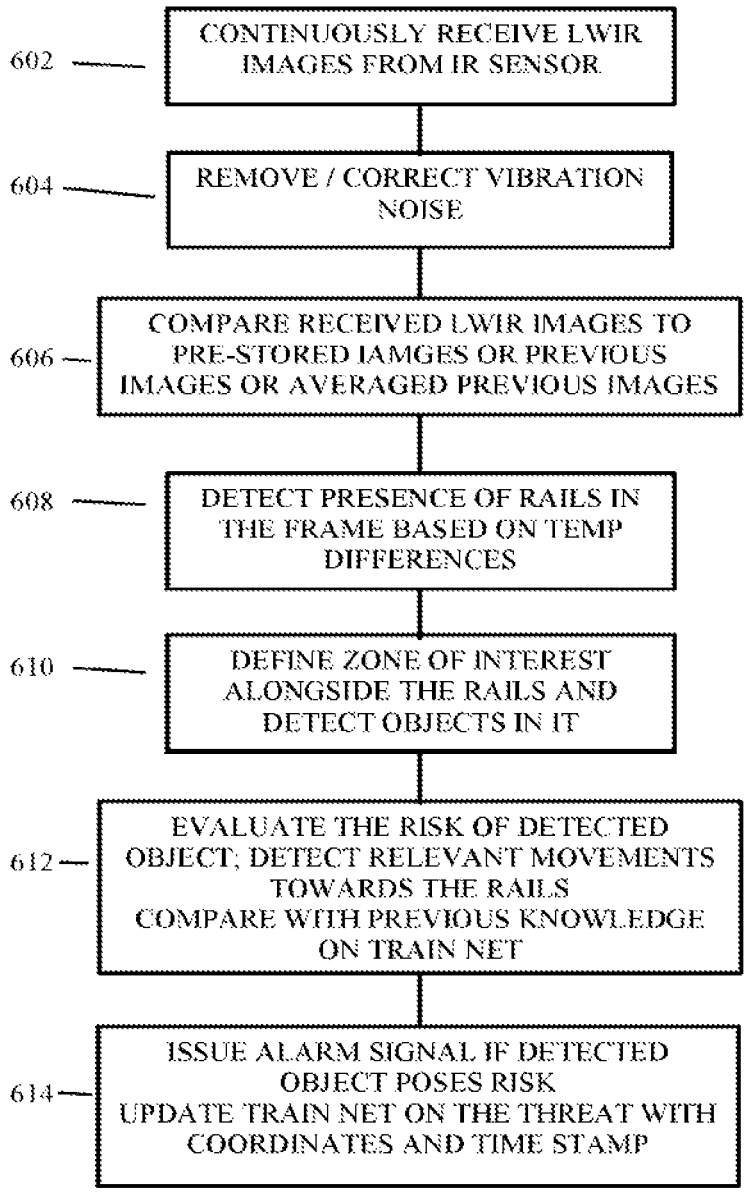
FIG. 6 is a schematic flow diagram presenting operation of a system for railway obstacle identification and avoidance, according to some embodiments of the present invention.

Reference is made now to FIG. 6, which is a schematic flow diagram presenting operation of a system for railway obstacle identification and avoidance, according to some embodiments of the present invention. IR images, for example LWIR images, may continuously (or intermittently) be received from an IR imager such as IR imager 106 (of FIG. 1 and FIG. 2A) (block 602).

The stream of IR images may be filtered to remove or partially eliminate vibration noises (block 604).

The vibrations noise reduced IR images may be compared to pre-stored images, or to previous images of the same travel or to averaged previous images (block 606).

Rails are detected in the image frame based on temperature differences between the rails and their background (block 608).

Zone of interest is defined around the detected rails and objects within the zone of interest are detected (block 610).

The potential risk of the detected objects is evaluated and/or potential risky movements are detected. Detected objects and potential risky movements are compared to respective previously stored knowledge, which may be received through wireless communication or from on-board storage means (block 612). It should be noted that not only stationary objects but also moving objects may be detected. In case a moving object is detected, the speed and direction of movement may be estimated by comparing the location and size of the moving object in consecutive images. For example, the speed of the moving object may be estimated by evaluating the distance that the object has moved between consecutive frames, taking into account the distance that the train has passed between these consecutive frames, and dividing the distance by the time period between the acquisitions of the frames. By evaluating the speed and direction of movement, it may be concluded whether that moving object poses a risk to the train or not.

For example, if a car is detected, and based on the analysis of the direction of movement it is determined that the car is driving in parallel to the train, then it may be concluded that the car does not pose a risk. However, if the analysis of the direction of movement of the car reveals that the car is approaching the tracks, and the analysis of the speed of movement reveals that the car may cross the tracks, then it may be concluded that the car poses a risk to the train.

When potential collision risk is detected, an alarm signal may be issued and presented to the train engine driver, and possibly an alarm signal and respective data is sent wirelessly to a central management facility (block 614).

Figure 7:
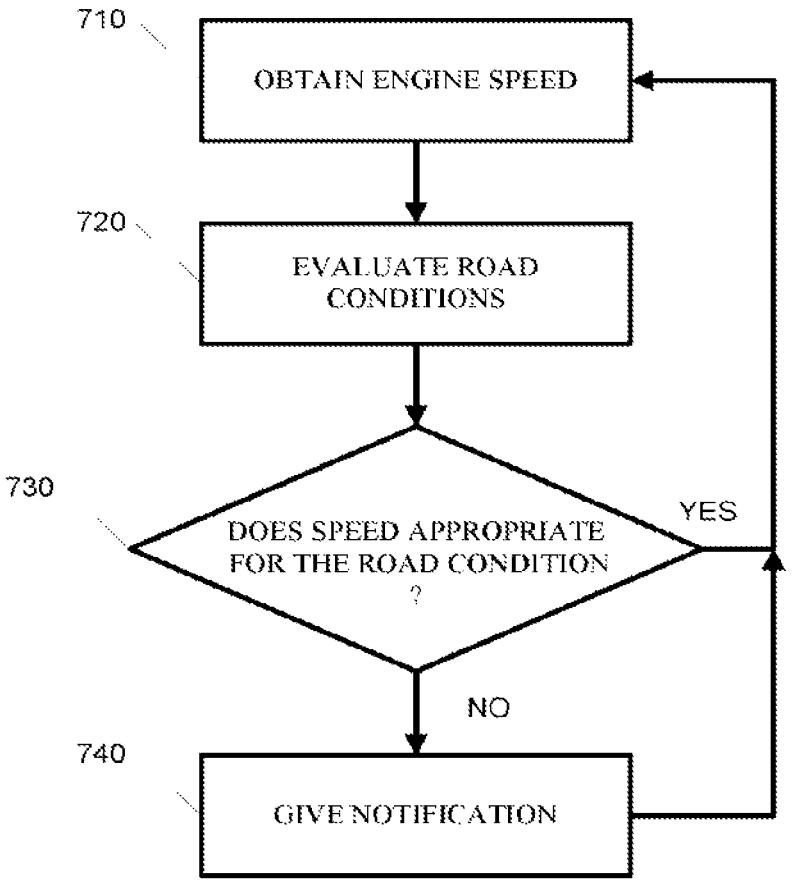
FIG. 7 is a schematic flow diagram presenting method for driving safety evaluation, according to some embodiments of the present invention.

Reference is made now to FIG. 7, which is a schematic flow diagram presenting method for driving safety evaluation, according to some embodiments of the present invention. The method for driving safety evaluation may be performed additionally or alternatively to blocks 606-614 of the operation of a system for railway obstacle identification and avoidance depicted in FIG. 6 and described hereinabove.

In block 710, the speed of the engine is obtained. The speed may be calculated based on the IR images received from the IR imager. For example, the speed may be calculated by evaluating the distance the engine has passed between consecutive images and dividing that distance by the time period between the acquisitions of the frames. The distance the engine has passed between consecutive images may be evaluated by performing registration between consecutive images. For example, objects or special signs located at the region of interest may be located in the IR images, and the distance the engine has passed between consecutive images may be evaluated by comparing the location and size of the located objects in consecutive frames. Additionally or alternatively, the speed of the engine may be obtained directly from the speedometer of the engine, from location data extracted from signals received from GPS satellites, for example, by GPS unit 242, or the speed may be obtained in any other applicable manner.

In block 720, the railway conditions are evaluated based on analysis of the IR images received from the IR imager. Rail track curvatures may be detected by observing the distance between the two tracks of the rails. If the rail tracks are straight, with no curvatures, the distance between the parallel tracks, marked D1 on FIG. 5E, should decrease gradually, at a known pattern, until the tracks converge in infinity. If the distance between the tracks decreases by more than the expected rate, for example, as seen at location D2 on FIG. 5E, it may be assumed that there is a curvature. The sharpness of the curvature, or the curvature radius, may be estimated by the pace of the decrease in the distance between the tracks. The distance from the curvature may also be estimated by observing the location on the IR image where the distance between the tracks start to decrease by more than the expected rate. The time to the curvature may be estimated based on the distance from the curvature and the speed of the engine derived in block 710.

In block 730, it is determined whether the speed of the engine is appropriate for the railway conditions. For example, the engine should slow to a certain speed when close to a curvature. If the speed of the engine close to the curvature is higher than that certain speed, a notification may be given to the engine driver, as indicated in block 740. The notification may be given to the driver, for example, through driver operation unit 104. For example, the driver may be warned that there is a curvature ahead and that he should slow the train. Additionally or alternatively, a notification may be sent to a central management facility (not shown), for example, through cellular interface unit 246, as may be desired.

Data gathered by system 100 for railway obstacle identification and avoidance may be saved by system 100 for later use and analysis. The data may include the speed of the train matched with information regarding railway conditions such as curvatures, the presence of obstacles, etc., and some or all of the IR images. The quality and safety of the driver may be analyzed, on line or off line, in normal journeys, as well as for the investigation of accidents. The data may be saved in storage means 102B, and/or the data may be sent and uploaded to a central management facility (not shown), for example, through cellular interface unit 246. Sending the data to be saved in the central management facility may reduce the required amount of storage capacity in storage means 102B.

According to some embodiments of the present invention, system 100 for railway obstacle identification and avoidance may be used for maintenance of an electric conducting system of the train, e.g., an overhead lines or a conductor rail. As used herein, overhead lines may refer to electric wire or wires used to transmit electrical energy to trains. Overhead lines may also refer to overhead line equipment (OLE or OHLE), overhead contact system (OCS), overhead equipment (OHE), overhead wiring (OHW), catenary or trolley wire. As used herein, a third rail or a conductor rail may refer to a conductor placed alongside or between the rails and used to power the train with electric power.

Electric trains often include an electric conducting system adjacent to it, including an overhead line cable for feeding the electric train, e.g., an electric wire or wires located generally above the rails. Some electric trains are powered by a conductor line placed alongside or between the rails. The electrical current flowing through the overhead line cable or conductor rail dissipates heat on the cable or conductor due to the resistivity of the conductor. When an electrical contact in a certain point is defected, e.g., bended, fatigued, etc., the effective cross-section of the conductor may decrease and due to that the resistivity at this point may increase. Accordingly, the dissipated heat at this point may be higher and therefore distinguishable by an IR sensor. The IR sensor may also enable detecting discontinuities in the overhead line cable or conductor rail such as a lumber on the cable etc. Thus, some embodiments of the present invention may be used to detect irregularities expressed, for example, by sudden change in the temperature of the conductor, in order to monitor the electric conductor system.

Figure 8:
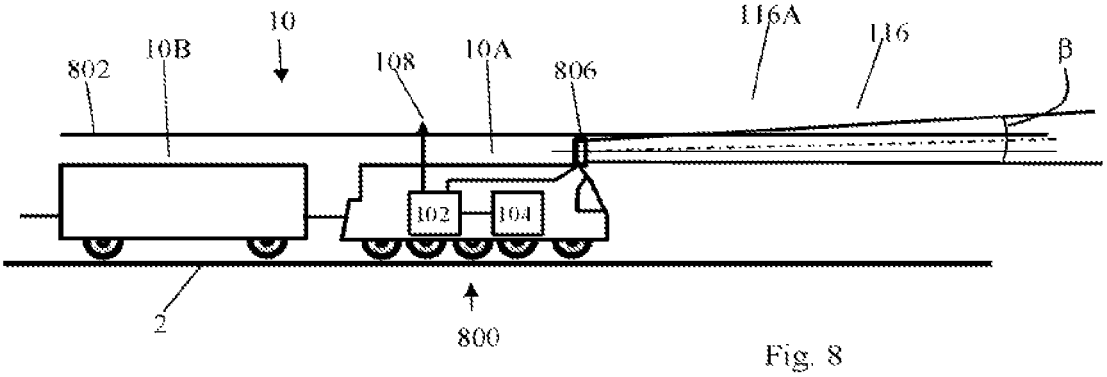
FIG. 8 schematically describes a train equipped with a system for electric conductor defects identification, according to some embodiments of the present invention.

Reference is made now to FIG. 8, which schematically describes train 10 equipped with system 800 for electric conductor defects identification, according to some embodiments of the present invention. Train 10 and system 800 may be generally similar to train 10 and system 100 depicted in FIGS. 1A and 1B, and similar components and features may are described again. Train 10 may include an IR sensor 806 for monitoring the electric conductor system, e.g., overhead line cable 802 or a conductor rail. The angle of view β of sensor 806 may be set to cover the location, ahead of train 10, of overhead line cable 802, that is to have, within the viewing angle θ an image of overhead cable 802 so that it may be monitored for completeness or for damages and irregularities. Overhead line cable 802 may include an electric wire or wires, electric connections and any other part of the electric system providing power to the train that is exposed to IR sensor 806. According to some embodiments, train may include a single sensor 106 or 806, with a wide enough FOV for monitoring both the rails as well as overhead line cable 802. In some embodiments, train 10 may include more than one sensor, for example, IR sensor 106 for monitoring the rails and IR sensor 806 for monitoring overhead line cable 802. The technical features of IR sensor 806 may be similar to those of IR sensor 106; however, this is not mandatory, and sensor 806 may be different than sensor 106, for example, each sensor may use same or different wavelength range. Additionally, similar techniques as disclosed herein may be used for stabilizing and aiming IR sensor 806, and for filtering vibrations, or for any other functionality disclosed herein with relation to IR sensor 106. For example, sensor 806 may filter vibration relaying on the easiness to locate cables of overhead line cable 802 (or the conductor rail) in the image frame due to its distinguished thermal features, similarly to relaying on locating the rails as disclosed herein. Additionally or alternatively, if two sensors are used, a single filter, derived for one IR sensor may be used for the second IR sensor as well. If train 10 is powered by a conductor rail, either IR sensor 806 or IR sensor 106 may be aimed at the conductor rail and detect defects as disclosed herein. While presented as mounted on the engine and facing the direction of travel this is not mandatory and the sensor may be installed in any proper position enabling visualizing of the electric conductor system.

Figure 9:
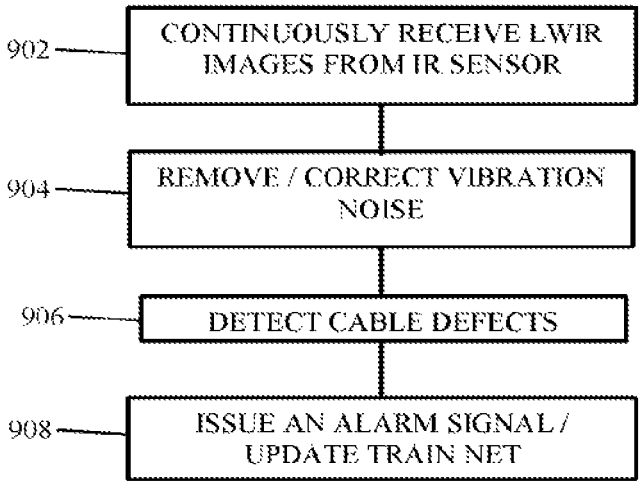
FIG. 9 is a schematic flow diagram presenting operation of a system for electric conductor defects detection, according to some embodiments of the present invention.

Reference is now made to FIG. 9, which is a schematic flow diagram presenting operation of a system for electric conductor defects detection, according to some embodiments of the present invention. The system for electric conductor defects detection may include, for example, system 800 depicted in FIG. 8, or any other suitable railway electric conductor defects detection system.

IR images, for example LWIR images, may continuously (or intermittently) be received from an IR imager such as IR imager 806 (of FIG. 8) or IR imager 106 (of FIGS. 1A and 1B) (block 902). The stream of IR images may be filtered to remove or partially eliminate vibration noises (block 904). Defects in the electric conducting system of the train, e.g., the overhead line cable or the conductor rail may be detected (block 906). For example, areas of elevated temperatures with relation to nearby areas of the electric conductor system, e.g., the overhead line cable or the conductor rail may be detected as areas of a potential defect. For example, areas in which the temperature difference is above a threshold may be detected and identified as areas that may be defected. Additionally, the system may identify as defected areas or points in the electric conductor system in which the absolute temperature is above a predetermined threshold. Additionally, the system may analyze the heat distribution along the electric conductor system to find patterns that are typical of possible defects. When a potential defect is detected, an alarm signal may be issued and presented to the train engine driver, and possibly an alarm signal and respective data is sent wirelessly to a central management facility (block 908).

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A system for detecting defects in an electric conductor rail of a train, the system comprising:
- an infrared (IR) sensor configured to face a direction of travel of the train and to acquire IR images;
- a processing unit to:
  - receive the IR images from the IR sensor;
  - detect rails in the IR images;
  - detect the electric conductor rail in the IR images based on the detected rails and a known position of the electric conductor rail with respect to the rails; and
  - detect a defect in the electric conductor rail based on the IR images.

2. The system of claim 1, wherein the processing unit is further configured to detect the electric conductor rail in the IR images based on temperature differences between the electric conductor rail and a background of the electric conductor rail.

3. The system of claim 1, wherein the processing unit is further configured to detect the defect in the electric conductor rail based on the IR images by detecting areas of elevated temperatures with relation to a background of the electric conductor rail.

4. The system of claim 1, wherein the processing unit is further configured to detect the defect in the electric conductor rail based on the IR images by detecting areas in which a temperature difference between the electric conductor rail and a background of the electric conductor rail is above a predetermined threshold.

5. The system of claim 1, wherein the processing unit is further configured to detect the defect in the electric conductor rail based on the IR images by detecting areas or points in the electric conductor rail in which an absolute temperature is above a predetermined threshold.

6. The system of claim 1, wherein the processing unit is further configured to detect the defect in the electric conductor rail based on the IR images by analyzing heat distribution along the electric conductor rail to find patterns that are typical of the defect.

7. The system of claim 1, wherein the processing unit is further configured to:
- determine a vibration profile based on a pattern and location of the electric conductor rail in the IR images; and
- filter effects of vibrations from the IR images based on the vibration profile.

8. The system of claim 1, wherein the processing unit is further configured to provide an alarm signal if the defect is detected in the electric conductor rail.

9. The system of claim 1, the system further comprising an engine driver operation unit configured to present an alarm signal to a user if the defect is detected in the electric conductor rail.

10. The system of claim 1, wherein the processing unit is further configured to send an alarm signal and data indicative of the defect to a central management facility if the defect is detected in the electric conductor rail.

11. A system for detecting defects in an electric conductor system of a train, the system comprising:

a first infrared (IR) sensor configured to acquire images of rails;

a second infrared (IR) sensor configured to acquire images of an electric conductor system;

a processing unit to:

receive a first set of infrared (IR) images from the first IR sensor;

detect the rails in the first set of IR images;

determine a vibration profile based on a location of the detected rails in the first set of IR images;

receive a second set of infrared (IR) images from the second IR;

filter effects of vibrations from the second set of IR images based on the vibration profile as determined from the first set of IR images, to provide a filtered set of IR images;

detect the electric conductor system in the filtered set of IR images; and detect defects in the electric conductor system based on the filtered IR images.

12. The system of claim 11, wherein the processing unit is further configured to detect the electric conductor system in the filtered IR images based on temperature differences between the electric conductor system and a background of the electric conductor system.

13. The system of claim 11, wherein the processing unit is further configured to detect the defect in the electric conductor system based on the filtered IR images by detecting areas of elevated temperatures with relation to a background of the electric conductor system.

14. The system of claim 11, wherein the processing unit is further configured to detect the defect in the electric conductor system based on the filtered IR images by detecting areas in which a temperature difference between the electric conductor system and a background of the electric conductor system is above a predetermined threshold.

15. The system of claim 11, wherein the processing unit is further configured to detect the defect in the electric conductor system based on the filtered IR images by detecting areas or points in the electric conductor system in which an absolute temperature is above a predetermined threshold.

16. The system of claim 11, wherein the processing unit is further configured to detect the defect in the electric conductor system based on the filtered IR images IR sensor by analyzing heat distribution along the electric conductor system to find patterns that are typical of the defect.

17. The system of claim 11, wherein the processing unit is further configured to provide an alarm signal if the defect is detected in the electric conductor system.

18. The system of claim 11, the system further comprising an engine driver operation unit configured to present and alarm signal to a user if the defect is detected in the electric conductor system.

19. The system of claim 11, wherein the processing unit is further configured to send an alarm signal and data indicative of the defect to a central management facility if the defect is detected in the electric conductor system.

20. A method of detecting defects in an electric conductor system of a train, the method comprising:

receiving a first set of infrared (IR) images from a first IR sensor configured to acquire images of rails;

detecting the rails in the first set of IR images;

determining a vibration profile based on a location of the detected rails in the first set of IR images;

receive a second set of infrared (IR) images from a second IR configured to acquire images of an electric conductor system;

filtering effects of vibrations from the second set of IR images based on the vibration profile as determined from the first set of IR images, to provide a filtered set of IR images;

detecting the electric conductor system in the filtered set of IR images; and detecting defects in the electric conductor system based on the filtered IR images.

* * * * *